United States Patent [19]

Levasseur

[11] Patent Number: 4,947,882

[45] Date of Patent: Aug. 14, 1990

[54] CRUTCHES, WALKING STICKS, AND THE LIKE

[76] Inventor: Daniel Levasseur, 64 Route du Rosemont La Planche-Le Prétre, 90200 Giromagny, France

[21] Appl. No.: 279,634

[22] Filed: Dec. 5, 1988

[30] Foreign Application Priority Data

Sep. 30, 1988 [FR] France ..... 88 12937

[51] Int. Cl.[5] ..... A61H 3/02; A45B 1/00

[52] U.S. Cl. ..... 135/84; 135/77; 135/86

[58] Field of Search ..... 135/84, 70, 77, 86, 135/65, 67

[56] References Cited

U.S. PATENT DOCUMENTS

| | | | |
|---|---|---|---|
| 862,455 | 8/1907 | Dunkel | 135/70 X |
| 1,348,531 | 8/1920 | Amadio | 135/84 X |
| 2,606,568 | 8/1952 | Walcot et al. | 135/80 |
| 2,753,586 | 7/1956 | Metz | 135/84 X |
| 2,910,995 | 11/1959 | Jacuzzi | 135/77 |
| 3,289,685 | 12/1966 | Parker | 135/77 X |
| 4,135,536 | 1/1979 | Willis | 135/84 |
| 4,440,186 | 4/1984 | Lottner | 135/84 |
| 4,510,957 | 4/1985 | Frank | 135/86 X |

FOREIGN PATENT DOCUMENTS

| | | | |
|---|---|---|---|
| 449581 | 7/1948 | Canada | 135/84 |
| 3004028 | 8/1981 | Fed. Rep. of Germany | 135/84 |
| 1246463 | 10/1960 | France | 135/77 |
| 73736 | 11/1916 | Switzerland | 135/77 |

*Primary Examiner*—David A. Scherbel
*Assistant Examiner*—Lan Mai
*Attorney, Agent, or Firm*—Sughrue, Mion, Zinn, Macpeak & Seas

[57] ABSTRACT

A stick in accordance with the invention essentially comprises a riser (3), a foot (1) defining a supporting polygon, a ball-and-socket joint connecting the riser (3) to the foot (1), and resilient means (12) for keeping the riser in a determined position relative to the foot, such that when the foot stands on substantially horizontal ground and when the resilient means are in the holding position, the riser remains in a substantially vertical position, with the supporting polygon being defined by five end fittings (2) positioned substantially at the vertices of a pentagon.

6 Claims, 2 Drawing Sheets

CRUTCHES, WALKING STICKS, AND THE LIKE

The present invention relates to all types of crutch and walking stick, and in particular to elbow-crutches (i.e. crutches of the type having a support for the forearm) as used by people suffering from relatively severe motor handicaps who may also have difficulties in bending down.

Conventional crutches and walking sticks are traditionally fitted with a simple rubber end fitting for reducing the extent to which they slip on the ground. The nature, substance, and shape of such end fittings do not prevent all types of slipping encountered by the user. Further, with some types of handicap, pressing against the ground at a single point (which is by definition unstable and, worse, occupies only a small area), can give rise to fatigue and a permanent state of tension in the arms which is bad for the health of the handicapped person.

Various devices have already been proposed to remedy these drawbacks. These devices include a tube suitable for being used interchangably with any type of crutch or walking stick and receiving a special foot which is articulated to the tube by a ball-and-socket joint. In addition, the foot includes a plurality of resilient projections for providing better adherence on the ground over an area which is very large compared with the area actually used by one of the above-mentioned single end pieces. The ball-and-socket joint allows the foot firstly to rotate freely relative to the tube, thereby ensuring that wear takes place uniformly on the projections, and secondly it allows it to adapt to ground irregularities.

However, for some people, these crutches or sticks suffer from a further drawback. Should they be accidentally dropped on the ground, they cannot easily be retrieved by their handicapped users who genrally also have difficulty in bending down.

The object of the present invention is to mitigate these drawbacks by providing a crutch or walking stick which is easily retrieved by its user even after it has falled to the ground, and which also bears against the ground in a highly stable manner. More particularly, the present invention provides a crutch, walking stick, or the like, comprising a riser, a foot defining a supporting polygon, and a ball-and-socket joint connecting the riser to the foot, characterized by the fact that the stick further includes resilient means for maintaining said riser in a determined position relative to the said foot, such that when the foot rests on substantially horizontal ground and said resilient means are in the holding position, said riser remains in a substantially vertical position, and by the fact that said supporting polygon is defined by five end pieces disposed substantially at the vertices of a pentagon.

Other characteristics and advantages of the present invention appear from the following description given by way of non-limiting example with reference to the accompanying drawings in which.

Figure 1:
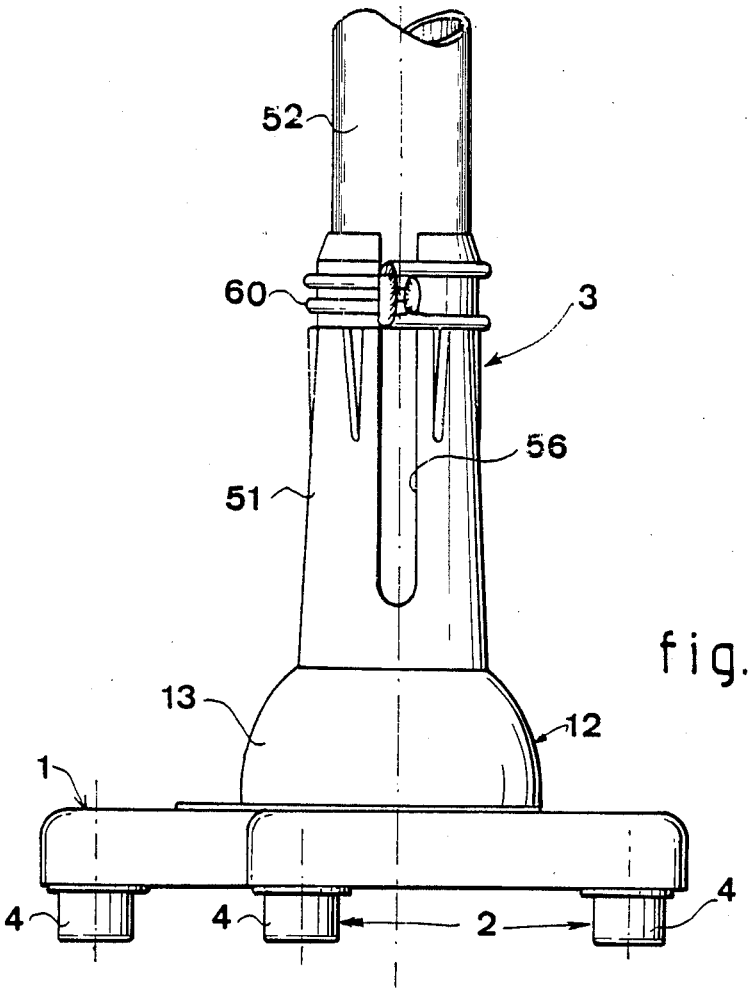
FIG. 1 is an elevation view of one embodiment of a stick in accordance with the invention.

The term "stick" is used herein to cover crutches, walking sticks, and other hand-held devices used by handicapped people as an aid in moving about.

FIGS. 1 to 4 show a portion of a stick including a foot 1 defining a supporting polygon of relatively large area, said foot 1 optionally including means such as rubber end fittings 2, for example, enabling it to keep position on the ground and avoid sliding. Naturally, various different forms of foot may be used. However, in a very advantageous embodiment, there are five end fittings situated at the vertices of a regular pentagon, thereby providing very good ground stability regardless of the irregularities of the ground on which the end fittings are placed, (within limits, of course).

In the embodiment shown in the figures, each end fitting is constituted by a cylinder 4 of relatively flexible material fixed at one end 5 to a cross-piece 6 integral with a rigid sleeve 7 which is in turn force-fitted in a recess 8 provided in the foot 1. This configuration makes it easy to replace a worn end fitting.

The stick also includes a riser or stick per se of appropriate shape for the user concerned, for example it may have a cradle for supporting the forearm, i.e. it may constitute an elbow-crutch.

The foot 1 and the riser 3 are interconnected by a ball-and-socket joint 9 having a male portion 10 which is generally spherical in shape and fixed to the riser 3 and a female portion 11 which is complementary to the male portion 10 and which is fixed to the foot 1. The joint 9 allows the riser 3 to point in any direction relative to the foot 1 when the user of the stick moves about.

However, people who suffer from severe motor handicaps and who use sticks of this type may accidentally allow them to drop on the ground. They then have great difficulty in retrieving them. Because of the ball-and-socket joint the riser can lean down towards the ground, thereby displacing the center of gravity of the stick out from the supporting polygon defined by the foot which causes the entire stick to topple over onto the ground as shown in solid lines in FIG. 4. The handicapped user then often has great difficulty in picking the stick up again.

Figure 2:
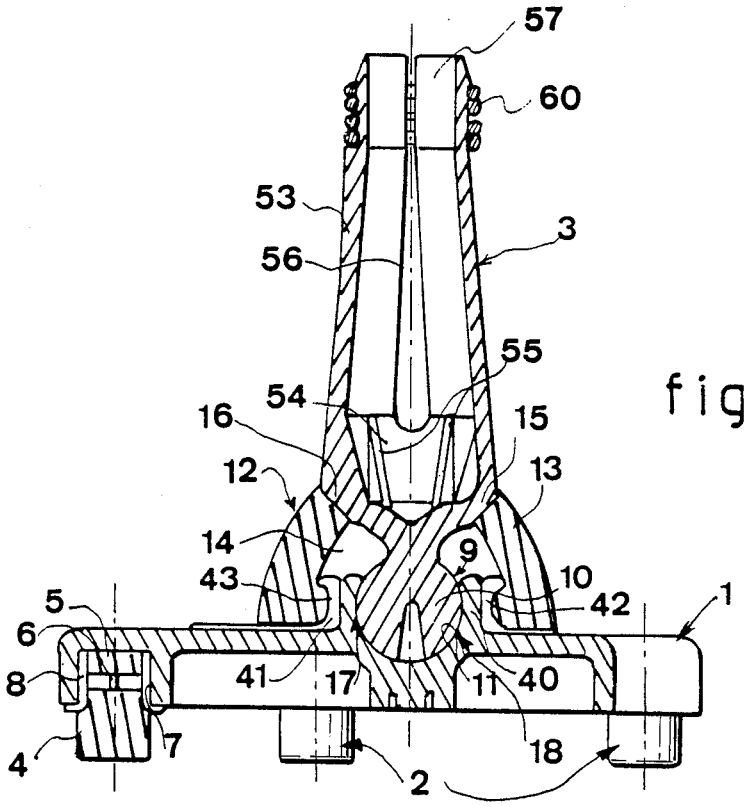
FIG. 2 is a section on line II—II of FIG. 3 through the FIG. 1 embodiment.
Figure 3:
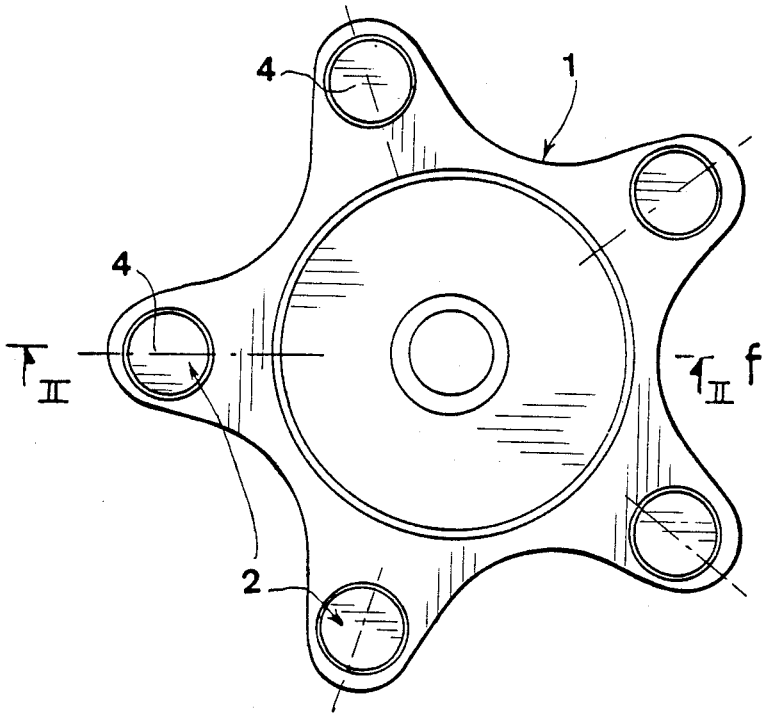
FIG. 3 is a plan view of the embodiment shown in FIGS. 1 and 2 showing, more particularly, the foot of the stick.

In order to mitigate this drawback, a stick in accordance with the invention has resilient means 12 which are visible, more particularly, in FIGS. 1 and 2. These means are essentially constituted by a ring 13 of resilient material substantially in the form of a truncated cone having a hollow void 14 defining an opening in its small base 15 which surrounds and imprisons the riser 3 at a portion 16 close to the ball 9, and an opening in its large base 17 which is fixed to the foot 1 around the socket 11 of the joint 9. In an advantageous embodiment, the menas 18 for fitting the ring 13 to the foot 1 include a shoulder 40 constituting an integral portion of the foot 1 and defining the socket 11 of the joint 9 in the center thereof. This shoulder is made to have a degree of elasticity in deformation so as to enable it to open up relatively easily when the ball 10 of the joint 9 is inserted therein. The means 18 for fixing the ring 13 to the foot 1 also include a sleeve 41 surrounding the shoulder 40 so as to clamp it and imprison the ball 10 of the joint 9. However, the sleeve 41 includes an annular groove 43 in its outside face 42 suitable for imprisoning a portion of the ring 13 which is complementarily in shape in order to hold the opening in the large base 17 of the ring on the foot 1. Since the shoulder 41 is fixed to the foot 1, since the ball 10 of the joint 9 is imprisoned in the cup 11, and since the sleeve clamps the shoulder, the assembly is retained resiliently and securely in position.

Further, the annular shape of the sleeve 41 surrounding the shoulder and the riser 3 makes it possible by exerting return forces to keep the riser without effort on an axis which is substantially perpendicular to the plane passing through the bearing surfaces of the five end fittings, thereby obtaining the looked-for result specified in the introduction.

The resilient stiffness of the ring material is determined so that the resilient force exerted on the riser is not too high, so as to allow the ring to function in a manner described below.

When such a stick is used by a handicapped person, the riser 3 can rotate about the center of rotation of the joint 9 relative to the socket 11 which is fixed to the foot 1, thereby allowing the person to perform such movements as needed in order to move over any type of ground, since the foot always remains in the same contact with the ground. Since this type of operation is known, per se, it is not described in greater detail below. However, in this relative movement of the ball relative to the cup in the joint, the ring 13 can easily deform under the action of the force exerted by the person moving, with the degree of reaction exerted by the ring as it deforms not being sufficient compared with the thrust exerted by the user to keep the riser 3 stationary relative to the foot 1.

When the person no longer needs to use the stick, the stick may be let go without fear of the riser 3 falling to the ground. Assuming that the user takes care to position the stick vertically or substantially vertically prior to letting it go, the riser is automatically maintained in the above-defined position under the action of the spring constituted by the ring 13, i.e. it remains substantially perpendicular to the plane passing through the ends of the end fittings 2. The handicapped person can thus release the stick which will continue standing upright throughout its period of non-use, and it will be very easy for the handicapped person to take hold of it again when next required.

Figure 4:
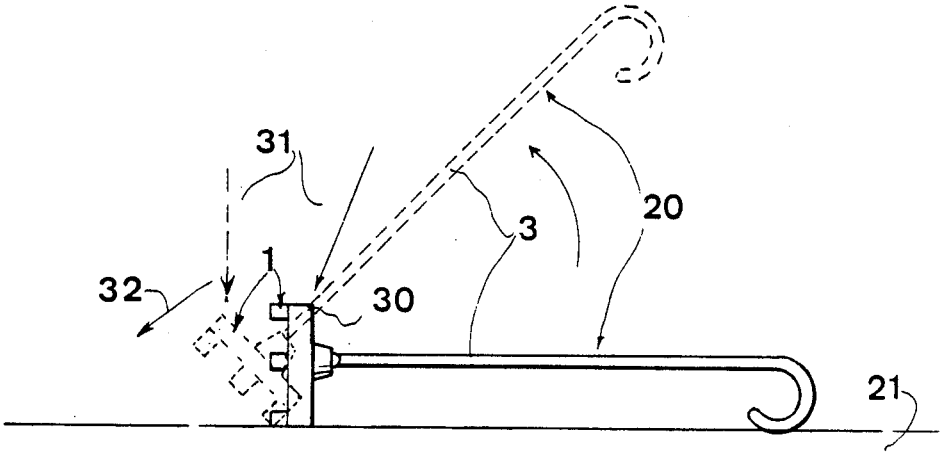
FIG. 4 is a diagram showing the advantages of a stick in accordance with the invention together with one of the ways in which it can be used.

However, should the stick fail to remain in the vertical position, for whatever reason, and fall to the ground, since its foot 1 takes up the position shown in FIG. 4, i.e. perpendicular to the axis of the riser 3, the handicapped person still has the possibility of applying a force represented in FIG. 4 by arrow 31 to a point 30 of the foot 1 in order to raise the stick 20 by causing it to rotate, e.g. as shown by arrow 32. If the force exerted by the ring 13 is properly set, the weight of the riser will not overcome the return force of the ring 13 during this rotation.

When the foot is back in normal contact with the ground, the riser is thus automatically back in its vertical position enabling the stick to be used by the handicapped person.

The advantage of such a device can thus be seen since it enables a person suffering from a motor handicap even a very considerable handicap, to move in complete safety over rough ground. The foot of the stick defines a supporting polygon of relatively large size, the foot makes contact with the ground via non-slip end fittings, and the riser is connected to the foot by means of a ball-and-socket joint allowing it to perform such rocking motions as are needed to allow the user to move without altering the contact between the foot and the ground. Further, the resilient means 12 allow a very handicapped person to take hold of the stick and use it again without needing to bend down, even in the worse of cases where the stick has fallen to the ground.

Further, in an advantageous embodiment, the riser 3 is made in two parts, a fixing lug 51 integral with the ball 10 of the joint 9, and a rod 52 suitable for being received in the lug 51. The rod 52 is simply constituted by a tube, e.g. of aluminum, which may be of various different diameters depending on requirements. In order to enable the rod 52 to be easily engaged in the lug 51, the lug is constituted by a hollow portion 53 having a bottom in the form of a truncated cone 54 centered on the axis of the riser 3. The surface of this truncated cone is advantageously lined with relatively narrow guides 55 so as to imprison the end of the rod 52 firmly inside the hollow piece 53.

In addition, the inside of the hollow piece 53 is larger in diameter than the largest possible diameter for a rod 52 while the diameter of the small base of the frustoconical bottom surface 54 is smaller than the diameter of the smallest possible rod. Further, the hollow piece 53 includes longitudinal slots 56 which impart it with a degree of deformation flexibility in order to allow its diameter to be reduced, particularly at the top 57. It is thus possible to make various different sticks using different diameter rods 52 but using a single assemply comprising a foot 1, and joint 9, with the rod 52 being jammed at its bottom end in the frustoconical bottom surface 54 and being held higher up inside the hollow piece 53 substantially level with its top 57 under the effect of a circular spring 60 surrounding it, for example.

I claim:

1. A walking stick, or the like, comprising a riser, a foot defining a supporting polygon, a ball-and-socket joint connecting the riser to the foot, resilient means for maintaining said riser in a determined position relative to said foot, such that when the foot rests on substantially horizontal ground and said resilient means are in the holding position, said riser remains in a substantially vertical position, said supporting polygon being defined by five end pieces disposed substantially at the vertices of a pentagon, said resilient means comprising a ring of resilient material substantially in the form of a truncated cone including a small base, a large base, a void interior defining an opening in the small base of the cone which surrounds and imprisons that portion of the riser which is closest to said joint, and an opening in the large base of the cone which is fixed to the foot around said socket of the joint, and wherein said means for fixing the ring to the foot are constituted by a shoulder forming an integral portion of said foot and defining the ball-receiving socket in the center thereof, said shoulder being resiliently deformable, and a sleeve surrounding said shoulder, said sleeve including an annular groove in its outside face suitable for imprisoning a complementary shaped portion of the ring.

2. A stick according to claim 1, characterized by the fact that each of said end fittings is constituted by a cylinder (4) of relatively flexible material having one end (5) fixed to a cross-piece (6) which is fixed to a rigid sleeve (7) that is a force-fit in a hollow recess (8) defined in the foot (1).

3. A stick according to claim 1, characterized by the fact that said foot (1) and said riser (3) are connected by a ball-and-socket joint (9) comprising a ball (10) which is spherical in shape and fixed to the riser and a socket (11) which is complementary in shape to the ball and which is fixed to the foot.

4. A stick according to claim 1, characterized by the fact that said riser (3) is made in two portions: a fixing lug (51); and a rod (52) suitable for being fixed to the lug (51).

5. A stick according to claim 4, characterized by the fact that said lug (51) is constituted by a hollow piece (53) whose bottom is in the form of a truncated cone (54), with the inside of said hollow piece being larger in diameter than the largest rod diameter, and with the diameter of the small base of the bottom frustoconical surface (54) being smaller than the diameter of the smallest possible rod.

6. A stick according to claim 5, characterized by the fact that said hollow piece (53) includes longitudinal slots (56) providing it with deformation and flexibility in order to make it possible to reduce its top diameter (57).

* * * * *